United States Patent [19]

Gottlieb

[11] 4,369,552

[45] Jan. 25, 1983

[54] LOCKING ASSEMBLY

[76] Inventor: Saul Gottlieb, 159 W. 53rd St., Apt. 23C, New York, N.Y. 10019

[21] Appl. No.: 247,723

[22] Filed: Mar. 26, 1981

[51] Int. Cl.[3] ..... A44B 19/00

[52] U.S. Cl. ..... 24/230 R

[58] Field of Search ..... 24/201 R, 201 A, 230, 24/231

[56] References Cited

U.S. PATENT DOCUMENTS

| | | | |
|---|---|---|---|
| 1,352,591 | 9/1920 | Eliasoff et al. | 24/230 R |
| 2,986,792 | 6/1961 | Wyatt | 24/230 R |
| 3,125,790 | 3/1964 | Gaylord | 24/201 R |
| 3,225,406 | 12/1965 | Levy | 24/230 R |
| 3,967,351 | 7/1976 | Rosenberg et al. | 24/201 A |
| 4,024,607 | 5/1977 | Rosenberg et al. | 24/230 R |

*Primary Examiner*—Gene Mancene
*Assistant Examiner*—Wenceslao J. Contreras
*Attorney, Agent, or Firm*—Martin Smolowitz

[57] ABSTRACT

A clasp device with a female member defined by an annular body and a male member adapted to be received into said female member. The female member is of unitary construction with a first opening and a second opening. These openings are spaced apart from one another with a passageway formed therebetween. The male member has a base member and a projecting member; the projecting member being affixed to and spaced apart from the base member through a positioning pin disposed in a space between the base member and the projecting member. This positioning pin is slidable through the passageway after the male member is inserted into said first opening of the female member and the female member is between the base member and said projecting member.

The male member is slidable into locking engagement with the female member by urging the positioning pin through the passageway into the second female opening, and locking the male and female members takes place by rotational movement of the male member. This urges the positioning pin to assume an orientation with respect to the second female opening sufficient to inhibit slidable movement of the male member with respect to said female member, through said passageway. Movement through the passageway takes place when the central axis of the male member is at 90° with respect to a central axis of said female member and by rotating the male member 90°, relative to said female member the positioning pin causes locking to take place.

18 Claims, 17 Drawing Figures

LOCKING ASSEMBLY

BACKGROUND OF INVENTION

The present invention relates to a releasible locking arrangement, such as, a clasp device employed in affixing the ends of a necklace or similar object into a secure position.

Some of the known structural arrangements as disclosed in the prior art employ male and female members in a working relationship but, the ability to provide for a simple, relatively secure, and easy to manufacture arrangement has not been set forth in the prior art.

For example, in U.S. Pat. No. 3,066,501, there is disclosed a structure for affixing necklace beads where one of a given pair of bead members has a resilient insert which is in the form of a protruding head. This is the male portion, which is on the end of an extended neck portion for engaging a socket or female of another bead. A resilient mouth at the point of entry at of the socket, has shaped lips and receives the head, such lips are dimensioned to receive and retain the respective beads in the socket to thus allow joining together of the beads while allowing for relative angular movement of the male and female arrangement once engaged in the socket. The entry of the head into the adjacent socket is through longitudinal or slidable movement with engagement being carried out by a restricted lip opening and lip deformation during the entry of the head into the socket. Positive locking is not assured.

In U.S. Pat. No. 3,208,238 the clasp for a necklace has a removable pin associated therewith which serves to open or engage the clasp locking members. The actual pin at its lower end seats into a recess and catch arrangement formed as part of an ornamental structure. Engagement of the clasp locking members and subsequent insertion of the pin through the openings formed therethrough is the sole basis for locking to take place.

In U.S. Pat. No. 2,266,074, locking action of a clasp takes place through engagement of a yieldable projection into a notch or slot with subsequent displacement of the projection or rib from notches allowing for free movement of the clasp.

In U.S. Pat. No. 4,001,913 a spring bias locking portion is urged into alignment with a central opening for engaging a neck portion of a male member and thereby locks the male at such point within the female. Release of the clasp is arranged by permitting the spring to cause disengagement of the neck area of a male member and allow withdrawal from the female passage. Basically, the locking action according to this patent is a function of slidable entry of a male portion into a female which in turn has a locking portion that is spring biased into an out of alignment with the path of travel of the male member.

In an another known device, namely, U.S. Pat. No. 4,110,873, there is provided a releasible coupling within elongated male member and a receiving structure having an entry as the female member. The male member is provided with a hook formation or detent at its end with an abutment in one direction. The female member has an abutment directed away from a passage and once the male member is inserted, engagement of the respective abutments occurs. A lug within the male portion governs the resilient hook movement within the passage in a direction of insertion. The resilient hook is displaceable out of register with the abutment of the female, to in turn permit withdrawal of the male projection from the passage. The hook formation which initiates locking has to be resiliently displaced relative to the lug so as to permit passage entry and release with respect to the female portion.

SUMMARY OF THE INVENTION

The present invention as will be more fully described hereinafter provides a clasp device including: a female member defined by an annular body; a male member, said male member being adapted to be received into said female member; said female member being of unitary construction having a first opening and a second opening; said first and second openings being spaced apart from one another and having a passage way formed therebetween; said male member comprises an assembly having a base member and a projecting member, said projecting member being affixed to and spaced apart from said base member through a positioning means disposed therebetween in a space formed between said base member and said projecting member, said positioning means being slidable through said passage way of said female member, after said male member is inserted into said first opening of said female member and said female member is positioned between said base member and said projecting member, said male member being slidable into locking engagement with said female member by urging said positioning means through said passageway into said second female opening, whereby locking of said male and female members takes place by rotational movement of said male member to urge said positioning means to assume an orientation with respect to said second female opening, sufficient to inhibit slidable movement of said male member with respect to said female member, through said passageway.

Also within the scope of the present invention is a clasp device in which said positioning means is affixed to said base member to allow movement through said passageway only when a central axis of said male member is at 90° with respect to a central axis of said female member, said male and female members being thereafter fully locked from a partially engaged position, by rotating said male member 90° relative to said female member, causing said positioning means to assume an orientation within said second opening of said female member for inhibiting relative movement of said male and female members through said passageway.

Accordingly, it is the main object of the present invention to overcome the defects of the prior art.

Another object of the present invention is to provide a locking assembly that is simple in construction and allows for positive locking of the male and female members of the assembly.

Still another object of the present invention is to provide a locking assembly wherein operation of the locking arrangement can be readily carried out to assure positive and accident free locking.

Still a further object of the present invention is to provide a jewelry clasp which is readily manufactured and free from a multiplicity of parts.

A further object of the present invention is to provide for integrally formed arrangement serving to assure the presence of the locking assembly in a ready to use condition at all times.

BRIEF DESCRIPTION OF THE DRAWINGS

With the above additional objects and advantages in view as will be set forth hereinafter, the present invention is directed to the arrangement hereinafter described by way of example and illustrated in the accompanied drawings of a preferred embodiment in which.

DESCRIPTION OF THE INVENTION

Figure 6:
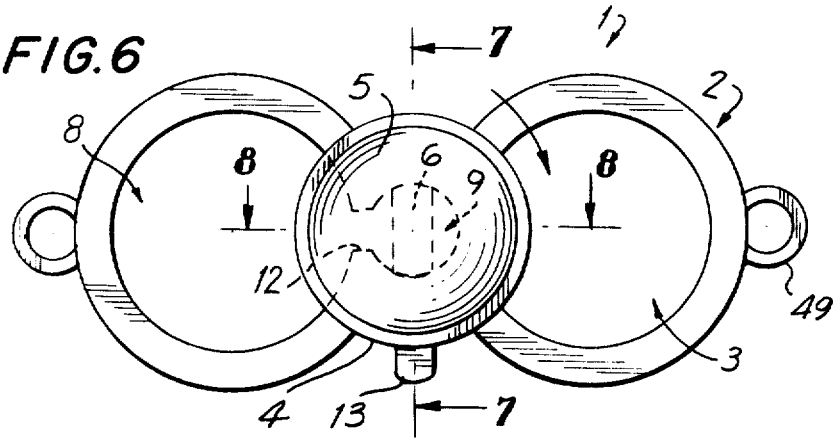
FIG. 6 illustrates the assembly of FIG. 2 in the fully locked position with complete engagement of the male and female members.

The clasp device 1 is comprised of a male member 2 and a female member 7. The female member 7 is formed of an annular body having a pair of openings 8, 9 and is of unitary construction. It is provided with a passageway 12 which serves to connect the openings 8, 9 of the female member 7. The opening 8 is sufficiently sized to receive the male member 2 through it. The male member 2 is defined by a base member 11 at one end of the male member and an opening 3 oppositely disposed in the same plane as the base member 11 which opening 3 is of a comparable size to female opening 8. The base member 11 has associated therewith a projecting tab member 4 which is disposed above the base member 11 and spaced apart therefrom. A positioning pin 6 fixedly attached to the base member 11 and projecting tab member 4, defines the space 10 formed between such elements 11 and 4. The clearance space 10 is of a sufficient amount such that engagement between the male member 2 and female member 7 can only arise through the orientation of the male member 2 at a 90° angle of placement with respect to the horizontal axis of the female member 7. Once complete sliding to the fullest takes place, which involves passage of the positioning pin 6 through the passageway 12 so as to fully be contained within the opening 9. The male member 2 in turn is rotated for 90°, such that the positioning pin 6 is at right angles to the passageway 12 as shown in FIG. 6. In effect after the male member 2 is inserted into the first opening 8 of the female member 7 as hereafter described locking is effectuated. The positioning pin 6 is defined in size sufficient to pass through the passageway 12 of the female member 7 to complete engagement and locking between the male member 2 and female member 7.

This aspect of the arrangement is quite important, since the locking arrangement defined by the respective elements comprising the male assembly of the projecting tab member 4 positioning pin 6 and base member 11, all must relate to registration entrance and locking with the female member 7.

Figure 2:
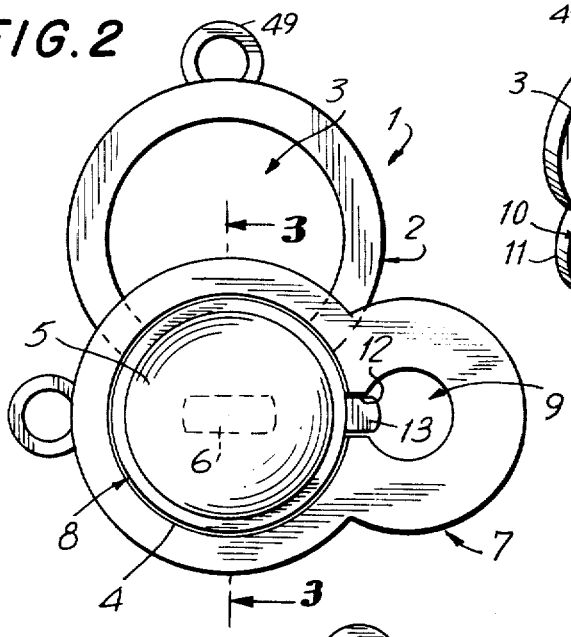
FIG. 2 is a front elevational view of the male and female members initial engagement but, not in a locking position.
Figure 4:
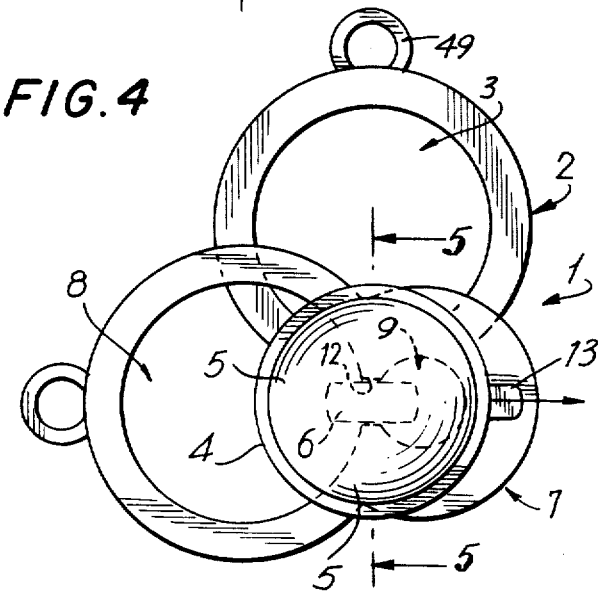
FIG. 4 illustrates the arrangement of FIG. 2 with the male member fully aligned with the female member and entry of the male member into the female member.

Initially, as per FIG. 2, the male member 2 is introduced through the opening 8 whereby the positioning pin 6 is in axial alignment with the passageway 12 to enable slidable movement of the male member 2 with respect to the female member 7 along the horizontal axis. As is shown in FIG. 4, such slidable movement with respect to the male member 2 and female member 7 can only arise through the orientation of the male member 2 at a 90° angle of placement with respect to the horizontal axis of the female member 7. Once complete sliding to the fullest takes place which involves passage of the positioning pin 6 through the channel 12 so as to fully be contained within the opening 9, the male member 2 in turn is then rotated for 90°, such that the positioning pin 6 is at right angles to the passageway 12 as shown in FIG. 6.

In effect, after the male member 2 is inserted into the first opening 8 of the female member, the female member 7 is positioned between the base member 11 and the projecting tab member 4. The male member 2 in turn is slidable into locking engagement with the female member 7 by urging the positioning pin 6 through the passageway 12 and into the second opening 9 of the female member 7. The orientation of the positioning pin 6 with respect to the second female opening 9 must be such, as to inhibit slidable movement of the male member 2 with respect to the female member 7. It is to be noted in evaluating the actual locking function between the male and female members, that the positioning pin 6 will only pass through the passageway 12 when the central axis of the male member 2 is at 90° with respect to the central axis of the female member. By rotating the male member 2 for 90° relative to the female member 7, the positioning pin 6 assumes the aforementioned orientation and locking takes place. Sufficient clearance exists for rotational movement of the male member 2 with respect to the female member 7 once the positioning pin 6 is within the opening 9. This obviously is necessary since further rotational movement is necessary since the disengagement process takes place by orienting the positioning pin 6 through rotation of the male member 2 in registration with the passageway 12, to enable slidable movement of the male member 2 along the horizontal axis from a fully locked to a loosely fitting relationship in the opening 8 and then subsequent withdrawal of the male member 2 from the opening 8, to complete the unlocking operation.

A flange portion 14 is provided in the projecting tab member 4 for receiving and allowing to be seated therein a jewel 5 or the like, for ornamentation purposes. Furthermore, the area and the opening for receiving the jewel in the projecting tab member 4 can be varied to suit the needs which may exist. Basically, such jewel 5 serves to cover the actual locking elements as has been described hereinabove.

In addition, an extension member 13 in the form of a safety member is affixed to the periphery of the projecting member 4 and is in registration with the positioning pin 6. This extension member 13 is adapted to freely move through the passageway 12, but is not in actual engagement with the wall surfaces of the opening 9 as is the case for the positioning pin 6. The projection member 13 is intended to serve as an additional safety member for minimizing the possibility of positioning pin 6 to entering passageway 12 unless and until it is in absolute axial alignment and registration therewith. The additional alignment required for the projection member 13 serves a very important purpose should any of the working surfaces of the positioning pin 6 become less than linear in shape and thereby cause some possibility of inadvertent movement through the passageway 12.

Figure 3:
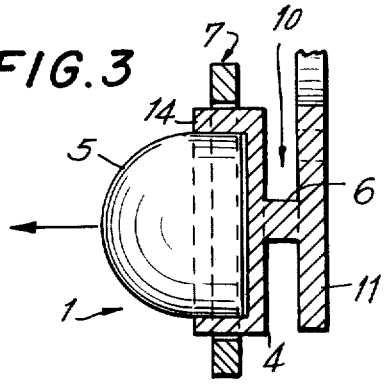
FIG. 3 is a cross-section taken along line 3—3 of FIG. 1.
Figure 5:
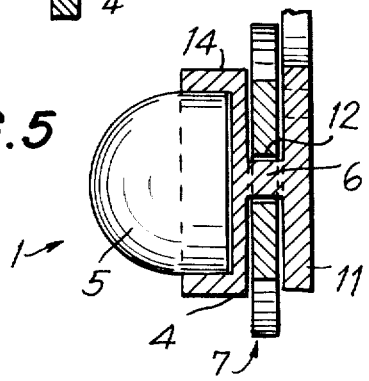
FIG. 5 is a cross-section taken along line 5—5 of FIG. 4.
Figure 7:
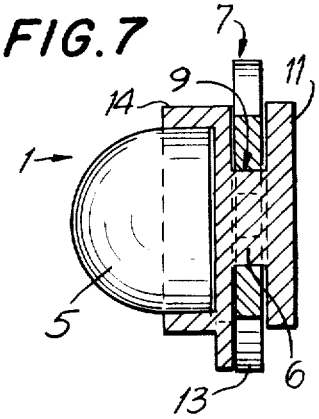
FIG. 7 is a cross-sectional view taken along line 7—7 of FIG. 6.
Figure 8:
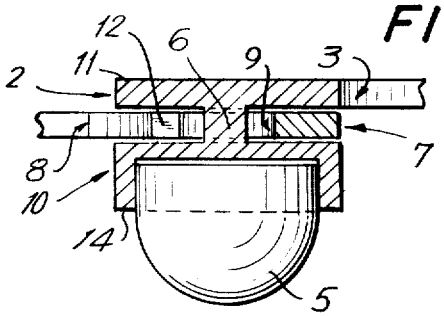
FIG. 8 is a cross-sectional view taken along line 8—8 of FIG. 6.

In FIGS. 3, 5 and 7 there are respectively shown various positions of the male member 2 and female member 7 at different stages of relative movement with respect to one another. In FIG. 3, the female member 7 is in loosely fitting contact with the projecting tab member 4 and is being urged to a position as is shown in FIG. 5, which is between the projecting tab member 4 and base member 11. The positioning pin 6 is in the passageway 12 as shown in FIG. 5. The locking configuration is illustrated in FIGS. 7 and 8 where clearly the male member 2 has been rotated for 90° from its initial position, with respect to the female member 2 and the positioning pin 6 is in locking arrangement with the opening 9 of female member 7. Then slidable movement between the male member 2 and female member 7 can no longer take place. FIGS. 7 and 8 illustrate the complete engagement of the male and female members respectively.

PREFERRED EMBODIMENT

A clasp device 1 with a female member 7 defined by an annular body and a male member 2 adapted to be received into said female member. The female member is of unitary construction with a first opening 3 and a second opening 9. These openings are spaced apart from one another with a passageway 12 formed therebetween. The male member 2 has a base member 11 and a projecting member 4; the projecting member 4 being affixed to and spaced apart from the base member 11 through a positioning pin 6 disposed in a space between the base member and the projecting member. This positioning pin 6 is slidable through the passageway 12 after the male member 2 is inserted into said first opening 3 of the female member and the female member is between the base member 11 and said projecting member 6.

The male member 2 is slidable into locking engagement with the female member 7 by urging the positioning pin 6 through the passageway 12 into the second female opening 9, and locking the male and female members takes place by rotational movement of the male member. This urges the positioning pin 6 to assume an orientation with respect to the second female opening 9 sufficient to inhibit slidable movement of the male member with respect to said female member, through said passageway. Movement through the passageway 12 takes place when the central axis of the male member 2 is at 90° with respect to a central axis of said female member 7 and by rotating the male member 90°, relative to said female member the positioning pin causes locking to take place.

Figure 1:
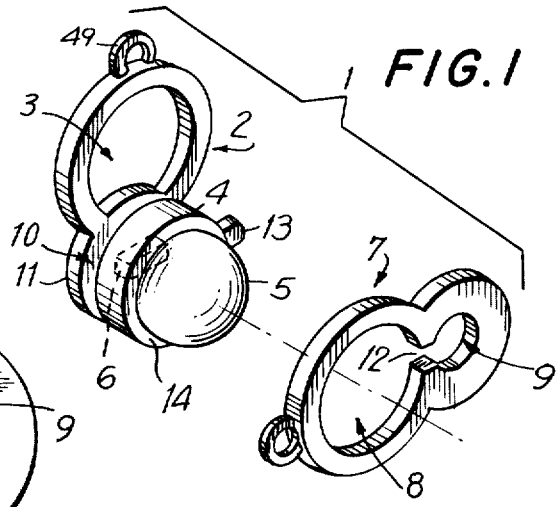
FIG. 1 is a perspective view of the clasp device of the present invention showing the male and female members.
Figure 9:
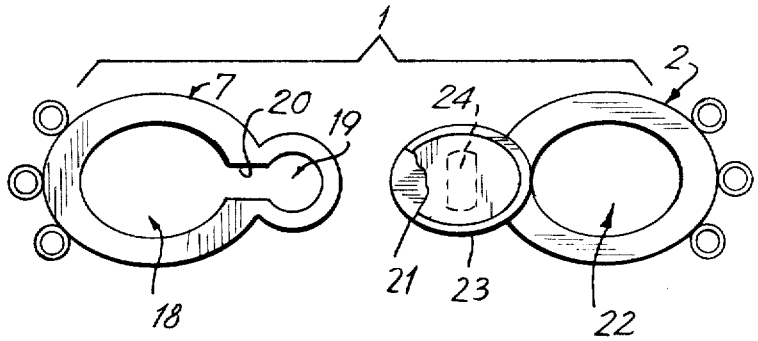
FIG. 9 is a front elevational view of an alternate embodiment of the present invention, illustrating a different configuration of the male and female members.
Figure 10:
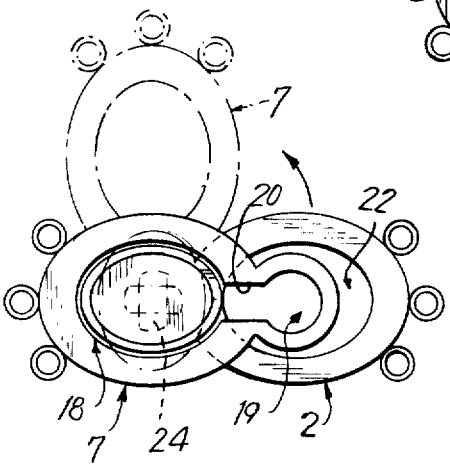
FIG. 10 illustrates the assembly of FIG. 9 illustrating an initial engagement of the male and female members.
Figure 11:
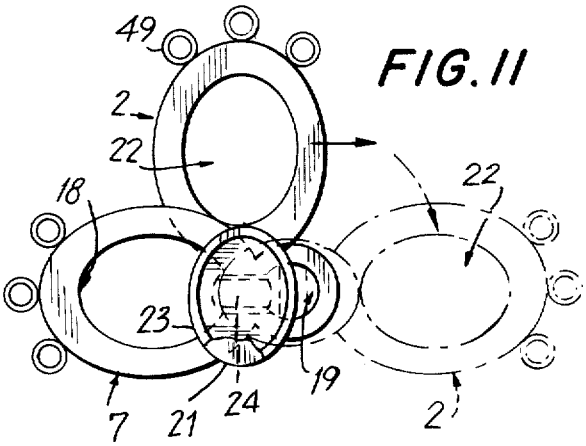
FIG. 11 illustrates further engagement of the assembly in FIG. 9 with locking of the male and female members.

FIG. 9 illustrates an alternate embodiment to the present invention in which the male member 2 and the female member 7 are shaped differently to that heretofore described in FIG. 1. It will be noted, that the first opening 18 in the female member 7 is eliptical in shape and the second smaller opening in the female member 19 is circular, similar to that shown and described hereinabove. The passageway 20 is likewise shaped with a pair of parallel wall surfaces defining the entrance way for the projecting member 21 of the male member 2. The opening 22 of the male member is similar in shape to the main opening of the female member 18. The projecting tab 23 is eliptical in shape and is adapted to be positioned through the opening 18 and function with respect to the female member 7, as was described hereinabove with respect to the principal embodiment. Likewise, there is provided a base member similar in disposition to that shown in preferred embodiments which cooperates with the projecting tab member 23 for engagement with female member 7. As is seen in FIGS. 10 and 11, the positioning pin 24 is intended to register with the passageway 20 as the male member 7 is in its initial engagement with the female member 7 by initially placing such male member through the opening 18. Thereafter, the male member is advanced along the central axis of the female member to permit the positioning pin 24 to pass through passageway 20 and into the opening 19. The male member, in turn, is rotated for 90° (as per FIG. 11), thus urging the positioning pin to become oriented at 90° with regard to the horizontal axis of the female member. At that point, the openings 18 and 22 are side-by-side with one another and in the same plane. This particular embodiment does not have need for the safety extension member 13 as shown in the preferred embodiment, since the degree of registration of the male member and female opening as well as, the positioning pin 24 through the passageway 20 will assure the proper orientation of these male and female members and avoid any unlocking when the positioning pin is not absolutely along the central axis of the passageway 20.

Obviously, as has been evidenced from the embodiment in FIGS. 9 through 11, the shape of the male and female members with respect to functionality and aesthetics can be varied within the context of always having proper orientation of the positioning pin and the passageway and subsequent engagement and placement of positioning pin 24 in the opening 19.

Figure 12:
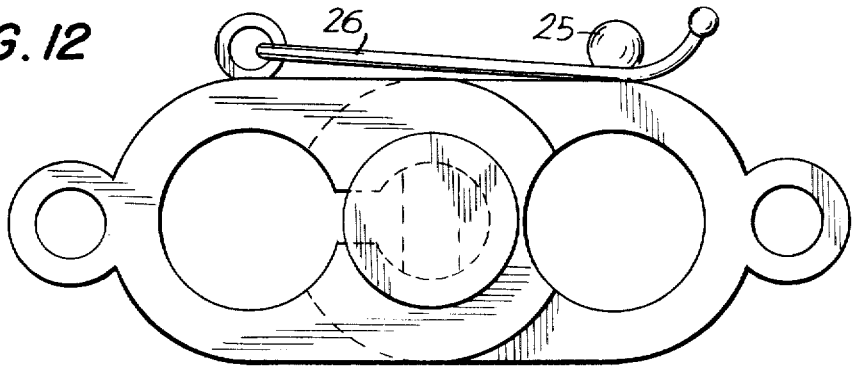
FIG. 12 is a front elevational view fully locked male and female assembly with an additional safety locking arrangement external of the assembly.

FIG. 12 illustrates the full engagement of a male and female members having the positioning pin in the locking mode. Here use of a secondary safety mechanism employing a ball member 25 which is affixed to the female member and an elongated member 26 with an opening at its working end for engagement with the ball member. This serves to provide an additional sense of protection to the clasp.

FIGS. 13, 14, 15, 16 and 17 are each directed to additional shapes and uses of the male and female members illustrating further utility of the basic inventive concept and its use.

Figure 13:
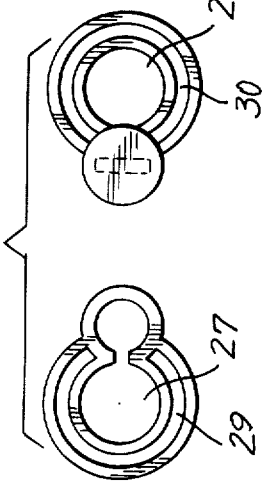
FIG. 13 is a front elevational view of still another alternate embodiment of the present invention illustrating different shaped male and female members.

FIG. 13 illustrates the male and female members each having a generally circular configuration with the larger openings 27 in the female member and 28 in the male member, respectively having a concentricly formed cut out areas 29, 30, to provide an additional configuration to the overall clasp when in the locked position.

Figure 14:
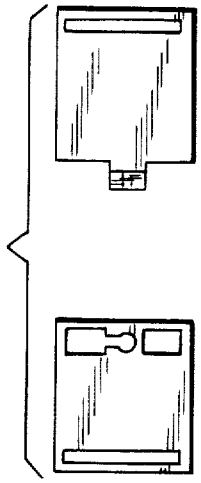
FIG. 14 is a front elevational view in schematic form of still another alternate embodiment of the present invention.

FIG. 14 illustrates a male and female member in which the basic locking concept can apply to a belt buckle, for example, with the orientation of the engaging portions necessitating further 90° rotation for locking engagement.

Figure 16:
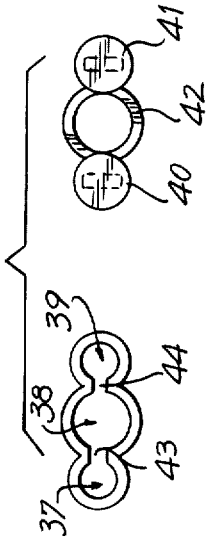
FIG. 16 is a front elevational view an alternate embodiment of FIG. 1, employing additional locking members.
Figure 15:
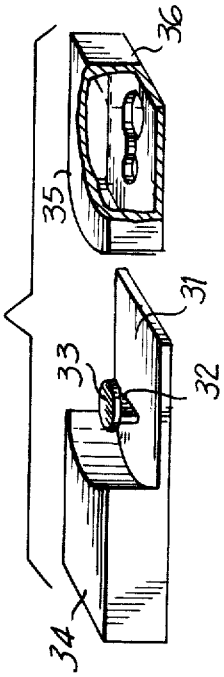
FIG. 15 is a perspective view, partially in broken view, illustrating an assembly employing the male and female members as set forth in FIG. 1, wherein the fully locked position, the assembly is enclosed within a casing.

FIG. 16 illustrates the locking arrangement where the male portion is defined by a base member 31 positioning pin 32 and tab member 33 formed of a male member 34 and the female member 35 when in locking engagement with the male member 34, fully encloses the male member 35 and provides a intergrally formed structure. The resultant combination has the male and female members respectively, internal of a casing 36 from which the female member is formed.

FIG. 16 provides a further illustration of how the present invention may be employed whereby, the respective male and female portions each have an additional opening such that the female member is provided with openings 37, 38, 39 and the male member is provided with two assemblies 40, 41, each comprised of a projecting tab member, positioning pin and base member (not shown). These respective assemblies are disposed to either side of the remainder of the male member and affixed thereto. The opening 42 of the male member is of the same size as the opening 38 of the female member. From this arrangement, it follows that locking can take place by employing a plurality of male and female members and having such elements, act as a progression of interconnecting elements or links of a particular item being formed. The passageways 43, 44, can each be permanently closed at the neck portion thereof, after locking by soldering or the like.

Figure 17:
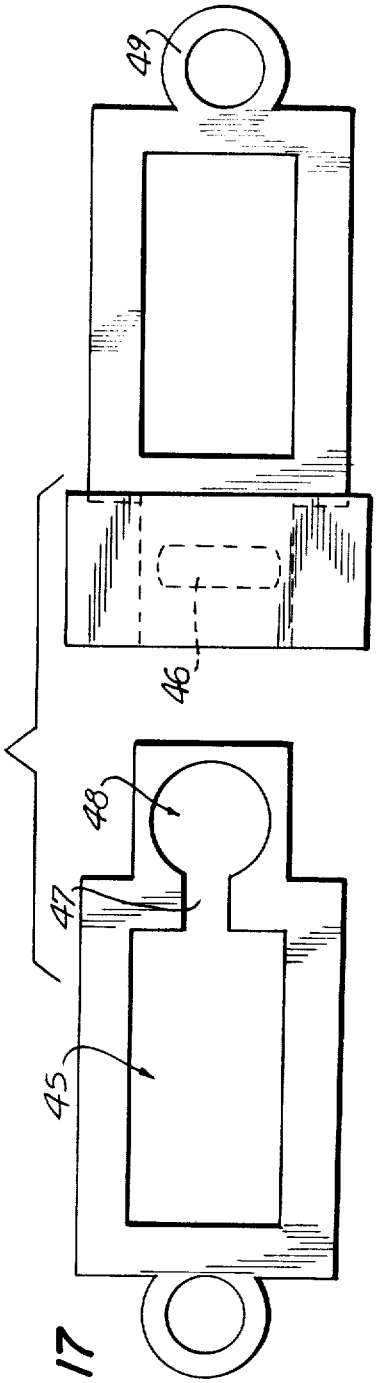
FIG. 17 is a front elevational view an alternate embodiment of the present invention with differently shaped male and female members.

FIG. 17 generally illustrates the use of male and female members which are basically rectangular in shape. The passageway for receiving the positioning pin and the second or smaller opening in the female member are similar in structure as has been described before and locking relationship takes place as was hereinbefore described. Again, the male member is initially disposed at a point through the opening 45 of the female member and the positioning pin 46 is urged through the passageway 47 into the opening 48, after which the male member is rotated to enable the positioning pin 46 to be in opposition with and at 90° with respect to the longitudinal axis of the female member including the passageway.

The male and female members, respectively, can each be provided with a individual or plurality of elements 49 connected to their end surfaces such as is illustrated in FIGS. 2 through 6 and 10 and 11, for affixing the clasp to a particular item such as a necklace, bracelet or the like.

The simplicity of the inventive design enables mass production of the locking assembly to be fabricated in a fashion which is foolproof while in use and at the same time quite simple in overall structure. The clasp device itself can be embellished by the use of different types of ornamentation in place of the jewel 5. The classes of material which may be employed in the manufacture of this invention vary from the precious or base metals and if desired of tough plastic material such as nylon, by various plastic molding methods known in the art. The preferential basis for manufacture is by: casting, punching, pressing, machining or other metal working methods which are well known in the jewelery finding art. Basically, when in the fully engaged position, the male and female members provide for a symmetrically disposed pleasantly appearing arrangement, in which the male assembly comprising the projecting tab and base member are central of the larger openings of the male and female members which form these respective elements. The concept employed in the present invention is clearly intended to provide for a multiplicity of uses such as for: bracelets, chains, belt buckles, necklaces, etc.

While there has been illustrated and described, the preferred embodiment of the invention, it is to be understood that this is not to be limited to the precise construction herein disclosed and that various changes and modifications may be made within the scope of the invention as defined in the appended claims.

What is claimed is:

1. A clasp device including: a female member defined by an annular body; a male member, said male member being adapted to be received into said female member; said female member being of unitary construction having a first opening and a second opening; said first and second openings being spaced apart from one another and having a passage way formed therebetween; said male member comprises an assembly having a base member and a projecting member, said projecting member being affixed to and spaced apart from said base member through a positioning means disposed therebetween in a space formed between said base member and said projecting member, said positioning means being slidable through said passage way of said female member, after said male member is inserted into said first opening of said female member and said female member is positioned between said base member and said projecting member, said male member being slidable into locking engagement with said female member by urging said positioning means through said passageway into said second female opening, whereby locking of said male and female members takes place by rotational movement of said male member to urge said positioning means to assume an orientation with respect to said second female opening, sufficient to inhibit slidable movement of said male member with respect to said female member, through said passage way.

2. A clasp device as claimed in claim 1, wherein: said positioning means is affixed to said base member to allow movement through said passageway only when a central axis of said male member is at 90° with respect to a central axis of said female member, said male and female members being thereafter fully locked from a partially engaged position, by rotating said male member 90° relative to said female member, causing said positioning means to assume an orientation within said second opening of said female member for inhibiting relative movement of said male and female members through said passageway.

3. A clasp device as claimed in either claims 1 or 2, wherein: said positioning means being disposed within said second opening at an angle of 90° with respect to the horizontal axis of said second opening, to thereby oppose relative movement of said male member through said passageway.

4. A clasp device as claimed in either claims 1, 2 or 3, wherein: said second opening is adapted to permit free rotation of said positioning means for 360° therein and allow for slidable movement through said passageway of said positioning means.

5. A clasp device as claimed in either claims 1, 2 or 3, wherein: said projecting member has at its upper most surface, an integrally formed receptacle adapted to receive a jewel or the like thereon.

6. A clasp device as claimed in either claims 1 or 2, wherein: said first and second female openings are circular in shape and being connected to one another by a passageway in the form of a channel disposed at a point in proximity to one another; said first circular opening being sufficiently large enough to permit the free passage therethrough of said base member of said male member and rotation of said male member for 90° with respect to said female member to permit registration of said positioning means with respect to wall surfaces defining said channel and hence urge said positioning means therethrough, to respectively position said base member and projecting member of said male member, respectively beneath and above said second opening of said female member and having locking action between said male and female members by rotational action of said male member for another 90°, resulting in said positioning means blocking relative movement of said male member and said female member through said channel and causing locking action between said male and female members.

7. A clasp device as claimed in either claims 1 or 2, wherein: said male member assembly includes said lower section having a unitary formed element with an opening at an end opposite to said base member similar in size to said first opening of said female member.

8. A clasp device as claimed in either claims 1 or 2, wherein: said projecting member is cylindrical in shape, having an end surface disposed above and in parallelism with an upper surface of said base member, said positioning means being centrally affixed to said end surface of said projecting member and to an upper surface of said base member, to thereby define a clearance space sufficient for free relative movement and alignment of said male and female members prior to locking engagement.

9. A clasp device as claimed in either claims 1 or 2, wherein: extension means are affixed at a peripheral point on said projecting member, said extension means being in registration with said positioning means and adapted to freely move through said passageway as said male member engages said female member during locking action.

10. A clasp device as claimed in either claims 1 or 2, wherein: said first opening of said female member is elliptical in shape and said projecting member of said male member being elliptical in shape for insertion into said first opening.

11. A clasp device as claimed in claim 10, wherein: said male member is provided with an opening being elliptical in shape.

12. A clasp device as claimed in either claims 1 or 2, wherein: said first opening of said female member is rectangular in shape and said projecting member of said male member is retangular in shape for insertion into said first opening.

13. A clasp device as claimed in claims 12, wherein: said male member is provided with a rectangular opening.

14. A clasp device as claimed in either claims 1 or 2, wherein: said female member is provided with a concentric "C" shaped opening surrounding said first opening and said male member is provided with an opening spaced apart from said base member, said opening being surrounded by a centrically spaced opening formed in said male member.

15. A clasp device as claimed in either claims 1 or 2, wherein: said female member is integrally formed with a casing, said lower portion of said casing defining said first and second openings and said passageway; and said male member being disposed on a body for receiving said female member formed with said casing, whereby upon locking, the resultant combination provides a unitarily formed structure with said male and female members internal of said casing.

16. A clasp device as claimed in either claims 1 or 2, wherein: said female member is provided with a third opening oppositely disposed with respect to said second opening and having a passageway extending from said first opening thereto; said male member having another assembly being defined by second base member, second projecting member and second positioning means each of which is identical to said base member, projecting member and positioning means, said another assembly being oppositely disposed of said base member, projecting body and positioning means as an extension of said female member and in horizontal axial alignment therewith, each of said male and female members being engagable with one or more respective opposite members for locking therewith.

17. A clasp device as claimed in claim 16, wherein: said passageways are each sealable after locking action occurs between said male and female members.

18. A clasp device as claimed in either claims 1 or 2, wherein: an externally mounted elongated movable member is fixedly attached to said female member and an abutment member to said male member, whereby upon locking of said male and female members resultant registration of said elongated movable member with said abutment occurs and enables engagement therebetween.

* * * * *